United States Patent [19]

Canela

[11] Patent Number: 4,579,559

[45] Date of Patent: Apr. 1, 1986

[54] WET TREATMENT OF CELLULOSIC TEXTILES USING MIXED ANIONIC AND NON-IONIC WETTING AGENTS

[75] Inventor: José Canela, Therwil, Switzerland

[73] Assignee: Sandoz Ltd., Basel, Switzerland

[21] Appl. No.: 644,701

[22] Filed: Aug. 27, 1984

[30] Foreign Application Priority Data

Sep. 1, 1983 [DE] Fed. Rep. of Germany ..... 3331565

[51] Int. Cl.[4] ..... D06M 1/00

[52] U.S. Cl. ..... 8/127.1; 8/543; 8/581; 8/584; 8/591; 8/918; 252/8.7; 252/8.9

[58] Field of Search ..... 8/116 P, 543, 584, 591; 252/8.7, 8.9

[56] References Cited

U.S. PATENT DOCUMENTS 2,067,927 1/1937 Kern ..... 8/584
2,794,004 5/1957 Ratti ..... 252/8.7
3,704,262 11/1972 Komor ..... 8/101
3,852,030 12/1974 Komor ..... 8/111
4,300,903 11/1981 Engelhardt et al. ..... 8/531

FOREIGN PATENT DOCUMENTS 2164235 6/1973 Fed. Rep. of Germany .
1534471 7/1968 France .

*Primary Examiner*—A. Lionel Clingman
*Attorney, Agent, or Firm*—Gerald D. Sharkin; Richard E. Vila; Thomas C. Doyle

[57] ABSTRACT

A method for treating a textile substrate comprising cellulosic fibres with an aqueous treatment liquor containing a mixture of (a) a secondary hydrophilic sulphonated n-paraffin containing at least 9 carbon atoms, and (b) an orthophosphoric acid triester, the weight ratio a:b being of from 1.4–4.0:1. This mixture of anionic and non-ionic wetting agents is particularly suitable for use in an aqueous medium having a high electrolyte content.

23 Claims, No Drawings

WET TREATMENT OF CELLULOSIC TEXTILES USING MIXED ANIONIC AND NON-IONIC WETTING AGENTS

The present invention relates to the treatment of a cellulosic textile material with an aqueous treatment liquor in the presence of a mixture of anionic and non-ionic wetting agents.

Cellulosic material is difficult to wet rapidly and uniformly by an aqueous treatment liquor. Not only is a wetting agent expected to act rapidly but also in depth and uniformly. As a further requirement, a wetting agent for cellulosic material has to be stable in the treatment liquors which usually have a high electrolyte content and very often a high alkali concentration.

It has now been found that the use of a specific mixture of anionic and non-ionic wetting agents in an aqueous treatment liquor improves the wetting of cellulosic textile material and consequently the treatment of the material.

Accordingly, the present invention provides a method for treating a textile substrate comprising cellulosic fibres with an aqueous treatment liquor containing a mixture of an anionic and a non-ionic wetting agent, which method comprises using as a mixture of such wetting agents (a) a secondary hydrophilic sulphonated n-paraffin containing at least 12 carbon atoms in admixture with (b) an orthophosphoric acid triester of formula I

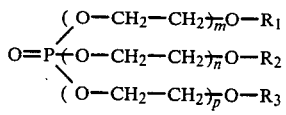

I in which each of $R_1$, $R_2$ and $R_3$, independently, is $C_{3-6}$alkyl, and each of m, n and p, independently, is 0 or 1 at a weight ratio a:b of from 1.4–4.0:1.

The sulphonated n-paraffins of component (a) are known products and are disclosed e.g. in "Anionic Surfactants" by W. Linfield, Vol. 7, part II, 330–334. They consist predominantly of sulphonated saturated hydrocarbons having a carbon atom chain of at least 12 carbon atoms, preferably from 12 to 20 carbon atoms; preferably they are sulphonated alkanes, particularly $C_{12-20}$alkanes, especially $C_{13-17}$alkanes, more preferably monosulphonated alkanes. By "secondary" is meant that the sulpho group is attached to a secondary carbon atom.

Component (a) may be prepared according to known sulphonation methods, for example by sulphoxidation (e.g. reaction with $SO_2$, oxygen and water) of n-alkanes or by sulphochlorination followed by hydrolysis or saponification. The resulting sulphonated n-paraffins are technical mixtures containing >85% monosulphonates, about 10% di- and polysulphonates, <1% non-sulphonated paraffin and optionally alkali metal sulphates (in the case of alkali metal sulphonates) and may be used directly as anionic wetting agent component (a). The secondary n-paraffin monosulphonates are mainly present in form of mixtures and may be characterised by the relative H-NMR (60 MHz, $D_2O$) peak intensities measured by automatic integration, of the hydrogens fixed on primary, secondary and tertiary carbon atoms. Preferred n-paraffin monosulphonates are those having the following H-NMR peak intensities:

| | | |
|---|---|---|
| ratio | $-CH_2-/-CH_3$ | 2.5–6.5 |
| ratio | $-CH_3/-\underset{\vert}{CH}-$ | 3.3–10.0 |
| ratio | $-CH_2-/-\underset{\vert}{CH}-$ | 19.0–30.0 |

$-CH_3$ peak at approximately 0.90 ppm (TMS as reference)

$-CH_2-$ peak at approximately 1.35 ppm $-CH-$ peak at approximately 2.70 ppm

Preferred n-paraffin monosulphonates are mixtures of compounds of formula II

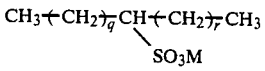

II in which q+r=9 to 17, and

M is a monovalent, colourless cation.

They may be represented by a single formula II in which (q+r) represents an average number, which may be non-integral.

Particularly preferred secondary n-paraffin monosulphonates are mixtures of compounds of formula II in which q+r=10 to 14.

The cation of the sulphonates (a), particularly M in the compounds of formula II, may be any conventional monovalent colourless cation, e.g. that of an alkali metal such as lithium, sodium, potassium, ammonium and substituted ammonium, e.g. mono-, di- or tri-ethanolammonium or -isopropanolammonium. A preferred cation is that of sodium.

In the compounds of formula I, each $R_1$, $R_2$ or $R_3$ may be branched or straight-chain alkyl, e.g. n-propyl, isopropyl, n-butyl, isobutyl, tert.-butyl, n-pentyl, isopentyl or n-hexyl, $C_4$-alkyl being preferred, especially n-butyl. Preferably $R_1$, $R_2$ and $R_3$ have the same significance. m, n and p are preferably identical, the preferred significance being 1.

Preferred non-ionic wetting agents (b) are esters of formula I in which the three ester groups are identical. More preferred phosphoric acid esters of formula I are tri-n-propylphosphate, tri-n-butylphosphate, tri-(n-butoxyethyl)phosphate and tri-n-pentyl phosphate, especially tri-(n-butoxy-ethyl)phosphate.

The weight ratio a:b is preferably 1.7–3:1.

The method of treatment of the invention is preferably carried out with a treatment liquor containing in addition to the mixture of wetting agents (a) and (b)

(c) a silicone based antifoaming agent.

Silicone based antifoaming agents are known compounds. They are organosiloxane polymers based on a structure which comprises alternate:silicon and oxygen atoms with various organic radicals attached to the silicon, e.g. polydimethylsiloxanes, polymethylphenylsiloxanes and polymethylhydrogensiloxanes having a mean MW of from 1000 to 100,000, preferably from 5000 to 40,000. The polymethylsiloxanes and/or the polymethylphenylsiloxanes may also exist in the form of a block polymer containing ethyleneoxy units and/or propyleneoxy units attached to the Si-O— and/or Si-C— groups. The terminal hydroxy groups present in the organosiloxanes may be blocked, e.g. by an ether group.

Preferred antifoaming agents (c) are poly-$C_{1-6}$ alkyl siloxanes having a viscosity at 25° C. of at least 0.7 cp. Further preferred polysiloxanes are polymethylsiloxanes having a viscosity at 25° C. of from 50 cp to 15 000 cp: particularly from 100 to 1000 cp, especially polymethylsiloxanes of formula III

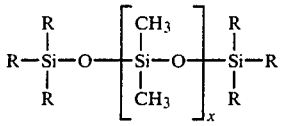

III in which R is methyl or methoxy, and x is an integral >1, preferably from 50 to 1200.

Such silicone based antifoaming agents are commercially available and may contain, in addition to the organopolysiloxanes, further ingredients such a colloidal silica gel or an emulsifying agent, e.g. based on polyethyleneglycol.

The antifoaming agent (c) is advantageously added in relatively small amounts e.g. to avoid the hydrophobic effect of the silicone oils (see H. Reuther in "Chemische Technik", 5 1953, 89; U.S. Pat. No. 2,632,736; UK Pat. No. 689 306; and DRG Pat. No. 5966). The antifoaming agent (c) is advantageously added to the mixture in an amount up to 35% by weight, preferably from 3 to 15%, based on the total weight of (a)+(b).

The wetting agents (a) and (b) may be added to the treatment liquor either separately or, preferably, together in the form of a composition. Such a composition which contains (a) and (b) and optionally (c) may be used in diluted or concentrated aqueous form or in a water-free form. Depending on the amount of water [designated hereafter as (d)] present, the composition may be in the form of a liquid or a paste. Concentrated compositions advantageously contain from 33 to 100% by weight of dry substance, preferably from 48 to 100% particularly from 50 to 70%, the remaining being water.

Suitable compositions include those having the following concentrations:

component (a): 1.4–4.0 parts, preferably 1.7–3.0 parts component (b): 1 part component (c): 0–35%, preferably 3–15% based on the total weight (a)+(b)

water (d): as sufficient for a total dry substance content of from 33–100%, preferably 48–100%, especially 50–70% by weight.

Such compositions may be further diluted before use. They are preferably used at a concentration <6 g/l calculated on the basis of (a)+(b), preferably from 0.05 to 4 g/l, particularly 0.1 to 2.5 g/l.

The wetting agent mixture is suitable for use in an aqueous treatment of cellulosic material; such a treatment can be for example a pre-treatment, e.g. desizing or scouring, as well as a finishing treatment, e.g. dyeing, optical brightening or a further permanent finishing such as softening or treatment with an antistatic agent, or an aftertreatment e.g. crease resistant finishing or a non permanent finishing with a softening or antistatic agent or a lubricant.

The wetting agent mixture is particularly suitable for use in an aqueous medium having a high electolyte content, e.g. containing salts such as sodium sulphate, sodium chloride, sodium or potassium carbonate or bicarbonate, borax and the like, or acids or bases. The pH of such aqueous treatment liquids may vary within a broad range from acidic to extreme alkaline values, particularly at a pH ranging from 4° Bé $H_2SO_4$ to 4° Bé NaOH.

The treatment of the invention may be carried out according to known methods, e.g. by a continuous or discontinuous method such as padding or exhaust, preferably by exhaust. Preferred treatments according to the invention are optical brightening and dyeing, preferably dyeing with direct, sulphur, vat and reactive dyestuffs. Such dyestuffs are known, e.g. from the Colour Index 3rd Edition. Preferred optical brightening agents are those derived from bis-(triazinylamino)-stilbene disulphonic acid.

According to a preferred embodiment of the invention, the wetting agent mixture is used as assistant for dyeing, e.g. by padding or exhaust, of cellulosic textile substrates with direct or reactive dyestuffs. The dyeing liquors used for dyeing with these dyestuffs have a high electrolyte content, e.g. due to the concentration of the dyestuff present in salt form, the presence of salts as extenders and/or the further addition of salts, e.g. sodium sulphate and/or chloride as dyeing assistants. The amount of salts added to the dyeing liquor may vary within a broad range, depending on the dyeing process used, the dyestuff concentration and the bath ratio; it may advantageously be at least 5 times the amount of dyestuff, preferably from 10 to 120 g/l, particularly 30 to 80 g/l. When reactive dyestuffs are used, the dyeing liquor additionally contains a basic compound, preferably an alkali metal carbonate and/or hydroxide, in such an amount to obtain a basic pH, preferably a pH from 8.5 to 13.5. The basic compound is usually added in an amount of from 0.1 to 50 g/l, advantageously from 2 to 40 g/l, to the dyeing liquor to obtain fixation of the reactive dyestuffs. When dyeing is effected by exhaustion, the liquor to goods ratio is from 1:3–1:100, preferably from 1:5 to 1:50, more preferably from 1:5 to 1:30; when the dyeing liquor is applied by padding on the substrate to be dyed, the pick-up of the liquor is advantageously from 50 to 150, preferably from 70 to 100%.

A particularly preferred treatment according to the invention is dyeing a cellulosic substrate with reactive dyestuffs either by exhaust or padding. In such a treatment, the dyeing liquor preferably contains a total of electrolytes of at least 45 g/l, particularly of at least 55 g/l.

By "cellulosic" substrate or material is to be understood a textile substrate comprising natural or regenerated cellulosic fibres, e.g. cotton, rayon or viscose, linen, hemp or jute, and their blends with synthetic or further natural fibres, e.g. polyester. The term "substrate" or "material" is used broadly to cover all stages of manufacture including filaments, threads, yarns, hanks, spools, woven, knitted or non wovens, and semi-finished or fully finished goods. Cotton is particularly preferred.

The wetting agent mixture has good wetting properties towards cellulosic substrates and thus contributes to improve the treatment carried out in its presence. For example, when the mixture is used in an optical brightening or dyeing process, the resulting brightening effects or dyeings have good properties. When the antifoaming agent (c) is used, foam formation is substantially prevented.

The following Examples in which all parts are by weight and all temperatures are in degrees Centigrade, illustrate the invention.

EXAMPLE 1

137.2 Parts Hostapur SAS (60% secondary sodium paraffinsulphonate from Hoechst, Germany) are introduced in a flask and heated to 35°–40°. After addition of 60.12 parts demineralised water, 41.17 parts tri-n-butoxyethyl-phosphate are added dropwise to the mixture while stirring. When the resulting mixture is homogeneous, 11.5 parts of the antifoaming agent SLM 54269 (antifoaming agent from Wacker Chemie AG. Switzerland) are added while stirring with caution to reduce the shearing force. The mixture is cooled under slightly stirring; at room temperature it is in the form of a gel having a dry substance content of 54%.

The paraffinsulphonate Hostapur SAS used above is characterised by its H-NMR spectra (60 MHz, $D_2O$) showing the following relative hydrogen peak intensities (measured by integration):

| | |
|---|---|
| $-CH_2-/-CH_3$ | 2.96 |
| $-CH_3/-\underset{\vert}{CH}-$ | 9.70 |
| $-CH_2/-\underset{\vert}{CH}-$ | 28.70 |

EXAMPLE 2

By following the procedure of Example 1 but using 39.52% of the sodium paraffinsulphonate of Example 1, 9.88% tri-n-butoxyethyl-phosphate, 4.6% of the silicone base antifoaming agent of Example 1 and 46% water, a gel composition is obtained having a dry substance content of 54%.

EXAMPLE 3

The procedure of Example 1 is repeated but 41.17 parts tri-n-butyl phosphate are used instead of 41.17 parts tri-n-butoxyethyl-phosphate. The resulting composition has a 54% dry substance content.

EXAMPLE 4

55.98 Parts of a secondary sodium paraffinsulphonate (as disclosed thereafter) are intensively mixed at 30° with 28 parts tri-n-butoxyethyl-phosphate. 7.82 Parts of the silicone based antifoaming agent of Example 1 are then added and, after stirring over 30 minutes, the mixture is diluted with further stirring with 78.2 parts water.

A stable composition with 54% dry substance content is thus obtained.

The paraffinsulphonate is produced by sulphochlorination of a $C_{12-20}$ paraffin followed by saponification. The resulting paraffin sulphonate has the following H-NMR characteristics:

| | relative peak intensities measured by integration |
|---|---|
| $-CH_2-/-CH_3$ | 6.09 |

-continued

| | relative peak intensities measured by integration |
|---|---|
| $-CH_3/-\underset{\vert}{CH}-$ | 3.43 |
| $-CH_2-/-\underset{\vert}{\underset{H}{C}}-$ | 20.93 |

EXAMPLE 5

103.41 Parts of the sodium paraffinsulphonate of Example 4 are dissolved in 82.95 parts water. 38.30 Parts tri-n-butylphosphate are then added to the solution at 40° and the whole is stirred for 30 minutes. The mixture is cooled to 30° while slightly stirring. After addition of 12.32 parts of a silicone based antifoaming agent (Rhodorsil 424 from Rhône-Poulenc, France), the resulting mixture is further stirred for 30 minutes.

There is obtained 237 parts of a composition with 65% dry substance content.

APPLICATION EXAMPLE A

Bleached cotton cretonne is treated at 30° for 10 minutes at a liquor ratio of 1:20 with an aqueous liquor containing 4% (based on the weight of the substrate) of the dyestuff C. I. Reactive Green 12 (containing about 60% salt as extender)

80 g/l NaCl, and 0.5 g/l of the mixture of Example 1.

The temperature of the dyebath is raised to 80° and, after addition of 20 g/l sodium carbonate, to the boil and dyeing is continued at the boil for 1 hour. After cooling to 60°, the cotton fabric is rinsed, soaped, rinsed and dried. A level dyeing is obtained, the foam formation being reduced to a minimum during the procedure.

The mixtures of Examples 2 to 5 may be used in analogous manner to Application Example A; the dyestuff C.I. Reactive Green 12 may be replaced by the dyestuffs C.I. Reactive Yellow 58, C.I. Reactive Red 56, C.I. Reactive Blue 8 or a mixture thereof or by C.I. Reactive Red 17.

APPLICATION EXAMPLE B

A 100% mercerised cotton satin fabric is padded with an aqueous liquor containing 10 g/l of the dyestuff C.I. Reactive Red 159 (containing about 50% sodium sulphate as extender) and 2 g/l of the mixture of Example 3 to a pick up of 80%. The fabric is then treated in a jigger containing 400% (based on the weight of the substrate) of an aqueous solution of 50 g/l calc. sodium sulphate. After two passages, 10 g/l sodium carbonate are added to the solution and after further two passages, further 10 g/l sodium carbonate are added. The fabric is then treated in the jigger at 40° for 60 minutes. After a warm overflow rinsing, the dyed fabric is soaped with 1 g/l sodium tripolyphosphate in two passages, warm and then cold rinsed and finally dried. There is obtained a fabric thoroughly dyed in a level brilliant red shade.

The mixtures of Examples 1, 2, 4 or 5 may be used in analogous manner to Application Example B.

What is claimed is:

1. A method for treating a textile substrate comprising cellulosic fibres with an aqueous treatment liquor having an electrolyte content of at least 45 g/l and containing a mixture of an anionic and non-ionic wetting agent, which method comprises using as the mixture of such wetting agents (a) a secondary hydrophilic sulphonated n-paraffin containing at least 12 carbon atoms in admixture with (b) an orthophosphoric acid triester of formula I

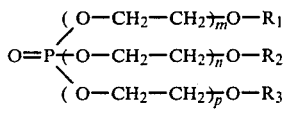

I in which each of $R_1$, $R_2$ and $R_3$, independently, is $C_{3-6}$alkyl, and each of m, n and p, independently, is 0 or 1 at a weight ratio a:b of from 1.4–4.0:1.

2. A method according to claim 1, in which component (a) is a monosulphonated $C_{13-17}$alkane.

3. A method according to claim 1, in which component (a) is a compound of formula II

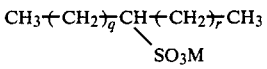

II in which q+r=9 to 17, and

M is a monovalent, colourless cation.

4. A method according to claim 1, in which component (b) is a compound of formula I in which $R_1$, $R_2$ and $R_3$ are identical.

5. A method according to claim 1, in which component (b) is selected from tri-n-propylphosphate, tri-n-butylphosphate, tri(n-butoxyethyl)phosphate and tri-n-pentyl phosphate.

6. A method according to claim 1, in which the weight ratio a:b is 1.7–3:1.

7. A method according to claim 1, in which the aqueous treatment liquor contains, in addition to components (a) and (b)

(c) a silicone based antifoaming agent.

8. A method according to claim 1, in which the mixture of (a) and (b) and optionally a silicone based anti-foaming agent (c) is used at a concentration <6 g/l based on the total weight (a)+(b).

9. A method according to claim 1 which is carried out within a pH range corresponding to from 4° Bé $H_2SO_4$ to 4° Bé NaOH.

10. A method according to claim 1, in which the aqueous treatment is a dyeing process.

11. A method according to claim 1, in which the aqueous treatment is a dyeing process with reactive dyes.

12. A method according to claim 10, in which the aqueous treatment liquor contains an amount of salt added as dyeing assistant, of at least 5 times the amount of dyestuff.

13. A method according to claim 11, in which the aqueous treatment liquor further contains a basic compound in an amount of from 0.1 to 50 g/l.

14. A method according to claim 1, in which the textile substrate comprises cotton.

15. A method according to claim 3 wherein component (a) is a mixture of compounds of formula II, component (b) is a compound of formula I in which $R_1$, $R_2$ and $R_3$ are identical and m, n and p are identical, and the aqueous treatment liquor has a total electrolyte content of at least 45 g/l and contains the mixture of (a) and (b) in a concentration of 0.05 to 4 g/l.

16. A method according to claim 15 wherein the aqueous treatment liquor contains a silicone based anti-foaming agent in an amount of 3 to 15% based on the total weight (a)+(b).

17. A method according to claim 16 wherein the silicon-based anti-foaming agent is a compound of formula III

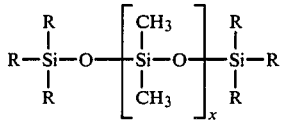

III in which

R is methyl or methoxy, and x is an integral from 50 to 1200.

18. A composition comprising a mixture of (a) a secondary hydrophilic sulphonated n-paraffin containing at least 12 carbon atoms, (b) an orthophosphoric acid triester of formula I

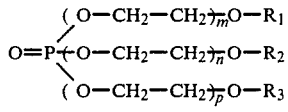

I in which each of $R_1$, $R_2$ and $R_3$, independently, is $C_{3-6}$alkyl, and each of m, n and p, independently, is 0 or 1 at a weight ratio a:b of from 1.4–4.0:1, and (c) a silicone based anti-foaming agent in an amount of 3 to 15% based on the total weight (a)+(b), the total dry substance content of said composition being from 33 to 100% by weight.

19. A composition according to claim 18 consisting essentially of (a), (b), (c) and (d) water.

20. A composition according to claim 18 wherein the weight ratio of (a):(b) is 1.7–3:1.

21. A composition according to claim 18 wherein component (b) is tri-(n-butoxy-ethyl)phosphate.

22. A composition according to claim 20 wherein (a) is a mixture of compounds of formula II

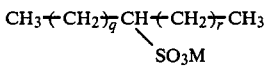

II in which q+r equals 9 to 17 and

M is a monovalent colorless cation, and (b) is a compound of formula I in which $R_1$, $R_2$ and $R_3$ are identical and m, n and p are identical.

23. A composition according to claim 22 wherein the silicone-based anti-foaming agent is a polymethylsiloxane having a viscosity at 25° C. of 50–15,000 cps.

* * * * *